US010194722B2

(12) United States Patent
Salander et al.

(10) Patent No.: US 10,194,722 B2
(45) Date of Patent: Feb. 5, 2019

(54) LUGGAGE ARTICLE HAVING OFFSET SUPPORT MEMBERS

(71) Applicant: Samsonite IP Holdings S.a.r.l., Luxembourg (LU)

(72) Inventors: Mark Tyler Salander, Little Compton, RI (US); Leticia Suarez-Lamus, East Providence, RI (US)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 0 days.

(21) Appl. No.: 15/452,766

(22) Filed: Mar. 8, 2017

(65) Prior Publication Data

US 2017/0258190 A1 Sep. 14, 2017

Related U.S. Application Data

(60) Provisional application No. 62/305,503, filed on Mar. 8, 2016.

(51) Int. Cl.

| | |
|---|---|
| ***A45C 5/14*** | (2006.01) |
| ***A45C 5/03*** | (2006.01) |
| ***A45C 13/00*** | (2006.01) |

(52) U.S. Cl.

CPC ..... *A45C 5/14* (2013.01); *A45C 5/03* (2013.01); *A45C 13/005* (2013.01); *A45C 2005/037* (2013.01)

(58) Field of Classification Search

CPC ... A45C 5/14; A45C 13/262; A45C 2013/267; A45C 13/005; A45C 2013/226

(Continued)

(56) References Cited

U.S. PATENT DOCUMENTS

| | | | | |
|---|---|---|---|---|
| 480,709 A * | 8/1892 | Capitan | ..... | A45C 5/14 190/18 A |
| 2,832,448 A * | 4/1958 | Axtell | ..... | A45C 5/02 190/122 |

(Continued)

FOREIGN PATENT DOCUMENTS

| | | |
|---|---|---|
| EM | 001236632-0002 | 9/2010 |
| EM | 002319996-0001 | 10/2013 |

(Continued)

OTHER PUBLICATIONS

Altman Luggage, Rimowa Salsa Deluxe Business Multiwheel 29L 83040, retrieved Oct. 27, 2016 at https://www.altmanluggage.com/rimowa830404.php, pp. 1-3.

(Continued)

*Primary Examiner* — Sue A Weaver

(74) *Attorney, Agent, or Firm* — Dorsey & Whitney LLP

(57) ABSTRACT

A luggage article having offset support members is provided. The luggage article may include a luggage case including first and second shells pivotably connected together at a split line by a hinge member. The luggage article may include a plurality of support members connected to the luggage case, each of the first and second shells including at least one of the plurality of support members. Each of the support members may be offset relative to a corresponding support member positioned on an opposite shell portion. The support members may be offset laterally in a direction parallel to the split line and/or the hinge member.

24 Claims, 6 Drawing Sheets

(58) Field of Classification Search
USPC ..... 190/112, 18 R, 18 A, 901
See application file for complete search history.

(56) References Cited

U.S. PATENT DOCUMENTS

| | | | | |
|---|---|---|---|---|
| 3,339,781 | A * | 9/1967 | Confer | A45C 5/02 190/18 R |
| 3,497,041 | A * | 2/1970 | Samhammer | A45C 5/03 190/115 |
| D218,080 | S | 7/1970 | Sierzega | |
| 4,027,754 | A | 6/1977 | Walker | |
| D272,870 | S | 3/1984 | Miles et al. | |
| D312,352 | S | 11/1990 | King | |
| 5,379,870 | A | 1/1995 | Sadow | |
| 5,407,038 | A | 4/1995 | Pedlar | |
| 5,685,403 | A | 11/1997 | Morszeck | |
| D402,463 | S | 12/1998 | Mettler | |
| 5,924,533 | A | 7/1999 | Cnockaert et al. | |
| D418,677 | S | 1/2000 | Sijmons | |
| D438,381 | S | 3/2001 | Sijmons | |
| D454,430 | S | 3/2002 | Sijmons | |
| 6,367,603 | B1 | 4/2002 | Tiramani et al. | |
| D463,910 | S | 10/2002 | Tchan | |
| 6,533,086 | B1 | 3/2003 | Waddell et al. | |
| D547,549 | S | 7/2007 | Johansson et al. | |
| D613,054 | S | 4/2010 | Morszeck | |
| D659,395 | S | 5/2012 | Sijmons | |
| D665,998 | S | 8/2012 | Sijmons | |
| D666,000 | S | 8/2012 | Gifford | |
| D675,018 | S | 1/2013 | Roberts | |
| D678,676 | S | 3/2013 | Bettua et al. | |
| D709,696 | S | 7/2014 | Wu | |
| D710,610 | S | 8/2014 | Sijmons et al. | |
| D718,048 | S | 11/2014 | Hsu | |
| D718,049 | S | 11/2014 | Hsu | |
| D718,051 | S | 11/2014 | Frahm et al. | |
| D722,771 | S | 2/2015 | Wu | |
| 9,016,449 | B1 | 4/2015 | Soboyejo | |
| D732,823 | S | 6/2015 | Baron | |
| D740,557 | S | 10/2015 | Liao | |
| D740,558 | S | 10/2015 | Liao | |
| D741,600 | S | 10/2015 | Della Vecchia | |
| D762,977 | S | 8/2016 | Xu | |
| D768,985 | S | 10/2016 | Morszeck | |
| 2006/0201764 | A1 | 9/2006 | Morszeck | |
| 2011/0284334 | A1 | 11/2011 | Cheng | |
| 2014/0131156 | A1* | 5/2014 | Farrelly | A45C 5/03 190/124 |
| 2014/0311847 | A1* | 10/2014 | Hillaert | A45C 5/14 190/18 A |
| 2016/0051022 | A1 | 2/2016 | Morszeck | |
| 2016/0262510 | A1 | 9/2016 | Shalgi | |

FOREIGN PATENT DOCUMENTS

| | | |
|---|---|---|
| EM | 002344622-0002 | 11/2013 |
| EM | 002454595-0001 | 4/2014 |
| EM | 002454595-0002 | 4/2014 |
| EM | 002576728-0001 | 11/2014 |
| EM | 002576728-0012 | 11/2014 |
| EM | 002576728-0013 | 11/2014 |
| EM | 002649558-0001 | 3/2015 |
| EM | 002684860-0001 | 4/2015 |
| EM | 002821082-0006 | 10/2015 |
| EM | 002872192-0003 | 11/2015 |
| EP | 0106906 A1 | 5/1984 |
| EP | 0106906 B1 | 7/1986 |
| EP | 3216365 A1 | 9/2017 |
| GB | 2319766 A | 6/1998 |
| HK | 1502398.1M006 | 11/2015 |
| WO | 2013/072086 A1 | 5/2013 |

OTHER PUBLICATIONS

Extended European Search Report of European Patent Application No. 17159950.9 dated Jul. 11, 2017, 8 pages.

* cited by examiner

LUGGAGE ARTICLE HAVING OFFSET SUPPORT MEMBERS

CROSS REFERENCE TO RELATED APPLICATION

This application claims the benefit, under 35 U.S.C. § 119(e), of U.S. provisional patent application No. 62/305,503, entitled "Luggage Article Having Offset Support Members" and filed on Mar. 8, 2016, which is hereby incorporated by reference herein in its entirety.

TECHNICAL FIELD

The present disclosure relates generally to wheeled luggage articles, and more specifically to luggage articles having offset support members to facilitate the luggage article to be fully opened.

BACKGROUND

Wheeled luggage articles often include an opening hinge located on the same plane as its support wheels. When the case is opened, the wheels on one half of the case come into contact with the wheels of the other half of the case to restrict the case from opening fully. Previous attempts to solve the above problems typically include reducing the size of the wheel supports. Luggage articles having small wheel supports, however, can be difficult to maneuver due to the small size of the wheels relative to typically encountered obstacles or rough terrain.

It is therefore desirable to provide an improved luggage article, and more specifically an improved foldable luggage article having offset support members that addresses the above described problems and/or which more generally offers improvements or an alternative to existing arrangements.

Documents that may be related to the present disclosure in that they include various luggage articles having offset support members include U.S. Pat. Nos. 5,924,533A, 6,533,086B1, EP106906B1, U.S. Pat. Nos. 5,407,038A, 6,367,603B1, and 5,379,870A.

SUMMARY

According to the present disclosure there is therefore provided a luggage article as described below and defined in the accompanying claims. The present disclosure advantageously provides a luggage article that opens flat when a hinge member is located on the same plane as the article's support members. As explained in detail below, through use of offsetting the support members in a direction parallel to the hinge member, a split case can be opened flat against a support surface without the support members interfering with one another. In this manner, the luggage article can be opened fully and laid flat with its contents completely exposed for unrestricted access and packing.

Embodiments of the present disclosure may include a luggage case. The luggage case may include a housing including a bottom panel and including first and second shell portions movable relative to each other between a closed position and an open position about a split line extending along a length of the bottom panel to define a first bottom panel portion and a second bottom panel portion. The bottom panel may include at least four support members, with at least two support members on each of the first and second bottom panel portions. The at least two support members on the first bottom panel portion may be offset from the at least two support members on the second bottom panel portion in a direction extending at least partially along the split line.

Embodiments of the present disclosure may include a luggage article. The luggage article may include a luggage case including first and second shell portions pivotably connected together at a split line, a first support member connected to the first shell portion, and a second support member connected to the second shell portion generally opposite the first support member across the split line. The first and second support members may be offset laterally relative to each other in a direction at least partially along a length of the split line.

Embodiments of the present disclosure may include a luggage article. The luggage article may include a luggage case including first and second shell portions pivotably connected together at a split line along a bottom end wall of the luggage case, and a plurality of support members connected to the bottom end wall, each of the first and second shell portions including at least one of the plurality of support members. The at least one support member connected to one of the first and second shell portions may be offset in a lateral direction along the bottom end wall and parallel to the split line.

Embodiments of the present disclosure may include a luggage article. The luggage article may include a luggage case including first and second shell portions connected together along a bottom end wall by a hinge member, a plurality of first support members connected to the first shell portion, and a plurality of second support members connected to the second shell portion. Each of the first support members may be offset laterally relative to a corresponding second support member along the bottom end wall in a direction parallel to the hinge member.

Additional embodiments and features are set forth in part in the description that follows, and will become apparent to those skilled in the art upon examination of the specification or may be learned by the practice of the disclosed subject matter. A further understanding of the nature and advantages of the present disclosure may be realized by reference to the remaining portions of the specification and the drawings, which forms a part of this disclosure. One of skill in the art will understand that each of the various aspects and features of the disclosure may advantageously be used separately in some instances, or in combination with other aspects and features of the disclosure in other instances.

BRIEF DESCRIPTION OF THE DRAWINGS

The description will be more fully understood with reference to the following figures in which components are not drawn to scale, which are presented as various embodiments of the disclosure and should not be construed as a complete recitation of the scope of the disclosure, characterized in that.

DETAILED DESCRIPTION

Figure 1:
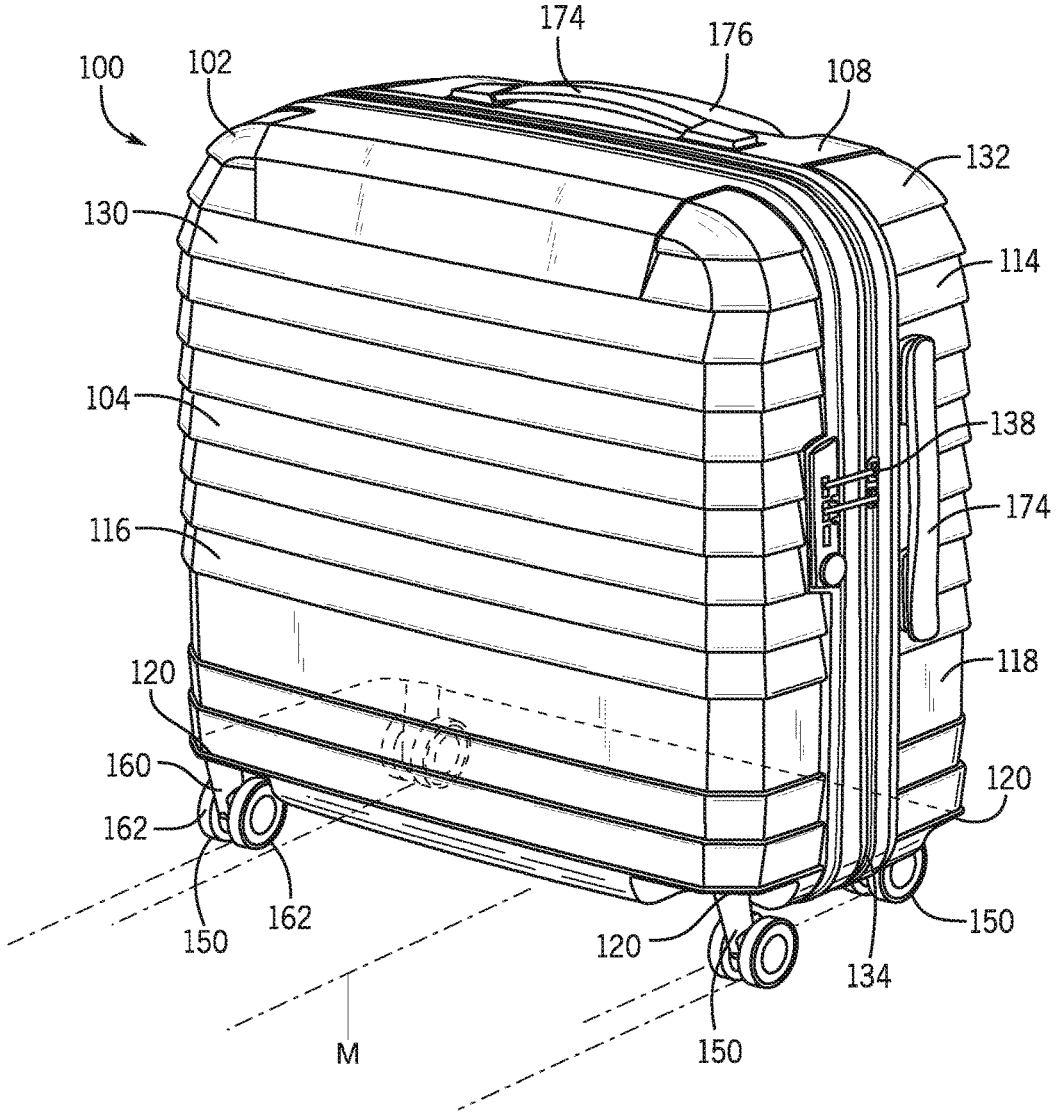
FIG. 1 is a front isometric view of a luggage article in accordance with some examples of the present disclosure.
Figure 2:
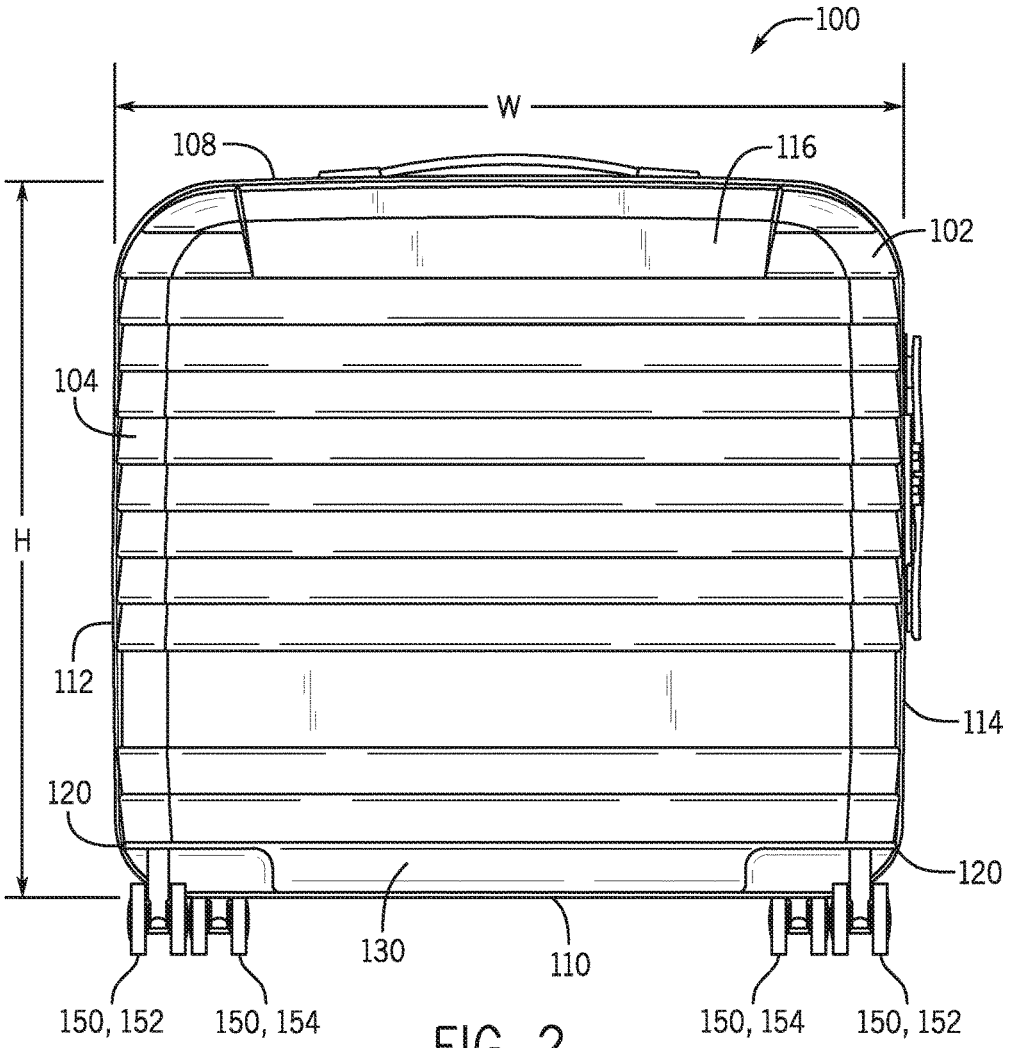
FIG. 2 is a front elevation view of the luggage article of FIG. 1 in accordance with some examples of the present disclosure.

Referring to FIGS. 1-5, a luggage article 100 according to an embodiment of the present disclosure includes a luggage case 102 formed from a plurality of walls defining an internal compartment in which to carry a user's belongings. The luggage article 100 includes opposing front and rear walls 104, 106, opposing top and bottom end walls 108, 110, and opposing left and right side walls 112, 114 that collectively define the outer structure or case of the luggage article 100 having a height H (see FIG. 2), a width W (see FIG. 2), and a depth D (see FIG. 4). The opposing front and rear walls 104, 106 may define major faces 116 of the luggage article 100, with the opposing left and right side walls 112, 114 and the opposing top and bottom end walls 108, 110 forming minor faces 118 of the luggage article 100. Corner regions are defined by the intersection of any two or three adjacent walls of the luggage case 102. For example, the luggage case 102 of FIGS. 1-5 includes four lower corner regions 120, each formed by the intersection of any two adjacent walls, such as the bottom end wall 110, one of the front and rear walls 104, 106, and one of the left and right side walls 112, 114. Additionally, edges formed by the intersection of any two adjacent walls, such as the bottom end wall 110 and one of the front and rear walls 104, 106, may be considered a "corner region."

With continued reference to FIGS. 1-5, the luggage case 102 may be formed from two shell portions (e.g., a first shell portion 130 and a second shell portion 132) pivotably connected (e.g., hinged) together at a split line 134 extending along the central portion of the minor faces 118 of the luggage article 100. In such embodiments, the first and second shell portions 130, 132 are movable relative to one another between a closed positon and an open position about a portion of the split line 134 extending along a length of the bottom end wall 110 to define first and second bottom panel portions 110A, 110B. In some embodiments, the open position may include a fully open orientation wherein the first and second shell portions 130, 132 extend in generally opposing directions from the split line 134. As described herein, opposing directions includes orientations wherein the first and second shell portions 130, 132 are positioned about 180 degrees relative to each other, between about 160 degrees and about 180 degrees relative to each other, between about 140 degrees and about 180 degrees relative to each other, between about 180 degrees and about 200 degrees relative to each other, or between about 180 degrees and about 220 degrees relative to each other and includes orientations when the luggage case 102 is opened on a flat surface, such as a table, floor, bed, or other support structure.

The first shell portion 130, which may be referred to as a lid section or a front shell, may include the front wall 104. The second shell portion 132, which may be referred to as a base section or a rear shell, may include the rear wall 106. In some embodiments, the first and second shell members may be substantially identical or at least include an equal depth. As illustrated in FIG. 5, a hinge member 136 (e.g., a fabric strip, a piano hinge, spaced apart discrete hinges, a living hinge, an articulating joint, or the like) may pivotably connect the first and second shell portions 130, 132 together along a portion of the split line 134, such as along the bottom end wall 110 of the luggage case 102. In this manner, at least a portion of the split line 134 extending along the bottom end wall 110 may be considered a hinge. In some embodiments, a closure mechanism 138, such as a zipper or a plurality of latches, may extend along the split line 134 to releasably secure the first shell portion 130 to the second shell portion 132. In the exemplary embodiment of FIGS. 1-5, the split line 134 extends substantially parallel to the major faces 116 of the luggage article 100, though it is contemplated the split line 134 may jog or extend, at least partially, at an angle relative to at least one major face 116 of the luggage article 100 in some embodiments Continuing to refer to FIGS. 1-5, the luggage article 100 may include a plurality of support members 150 operable to support the luggage article 100 when in a closed configuration. In some embodiments, each of the plurality of support members 150 may be connected to the bottom end wall 110 of the luggage case 102 to support the luggage article 100 in an upright position. Each of the first and second shell portions 130, 132 may include at least one of the plurality of support members 150. For example, at least one first support member 152 may be connected to the first shell portion 130, and at least one second support member 154 may be connected to the second shell portion 132. In some embodiments, the bottom end wall 110 includes at least four support members 150, with at least two support members 150 positioned on each of the first and second bottom panel portions 110A, 110B. As illustrated in at least FIG. 1, each support member 150 may be connected to the bottom end wall 110 adjacent an edge or corner of the luggage article 100 (e.g., adjacent the four lower corner regions 120) to provide sufficient lateral stability for the luggage case 102.

As best seen in FIG. 5, the support member(s) 150 of the first shell portion 130 are mounted to the luggage case 102 generally opposite the support member(s) 150 of the second shell portion 132 across the split line 134. In this manner, one of the first and second shell portions 130, 132 may include at least one support member 150 that corresponds with (or opposes) at least one support member 150 of the other of the first and second shell portions 130, 132 relative to the split line 134. As described herein, corresponding or opposing support members refers to support members 150 positioned across the split line 134 on opposing shell portions 130, 132 and that interact with one another when the luggage case 102 is opened. As explained more fully below, the support members 150 may be positioned along the bottom end wall 110 in a manner to facilitate the luggage case 102 to be fully opened without interference caused by corresponding or opposing support members 150. For example, each of the support members 150 may be offset relative to a corresponding support member 150 positioned on an opposite shell portion. As more fully explained below, in some embodiments, the two support members 150 on the first bottom panel portion 110A may be offset from the two support members on the second bottom panel portion 110B in a direction extending at least partially along the split line 134. Although shown and described as attached to the bottom end wall 110, the support members 150 may be positioned on any wall of the luggage article 100 whereat the luggage article 100 is pivoted or hinged.

Figure 8:
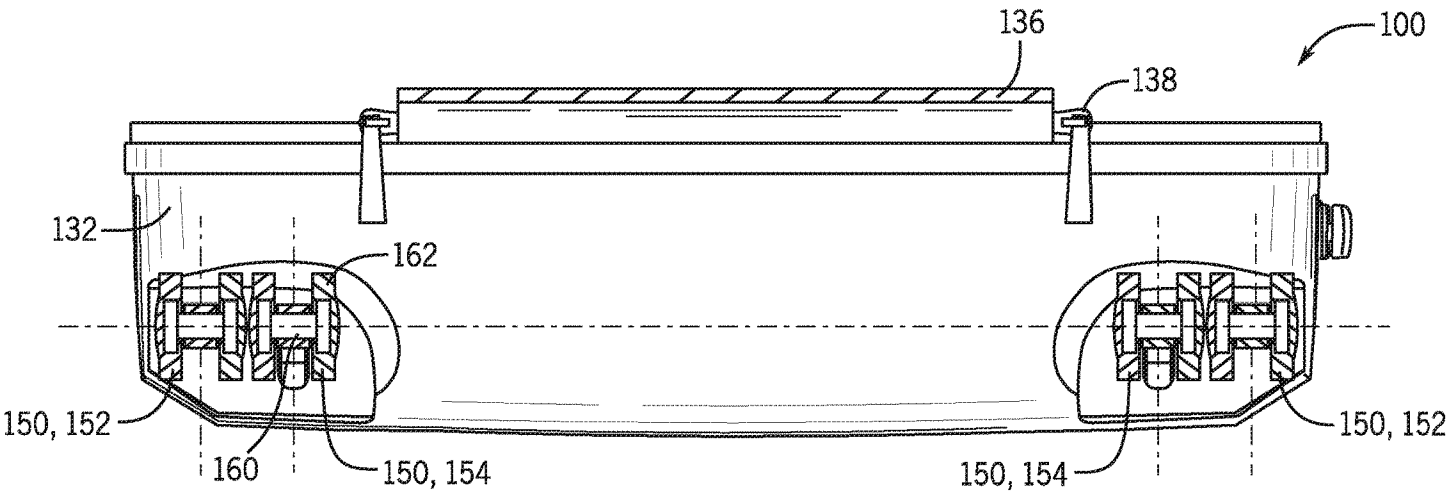
FIG. 8 is a fragmentary cross-sectional view of the luggage article of FIG. 6 taken along line 8-8 of FIG. 7 in accordance with some examples of the present disclosure.
Figure 9:
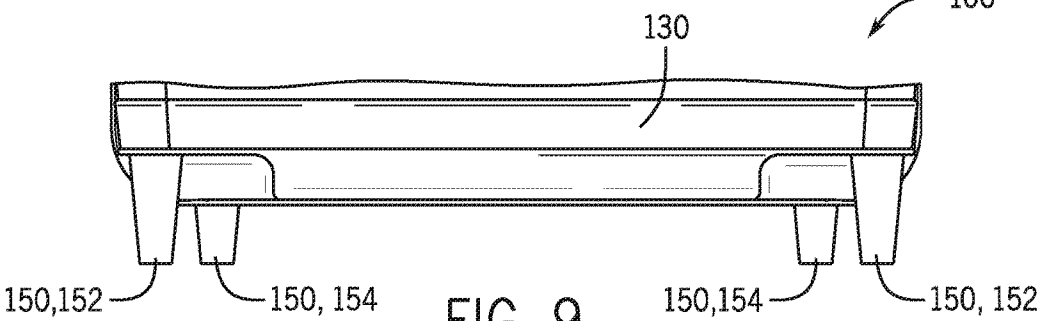
FIG. 9 is an enlarged fragmentary view of an additional luggage article in accordance with some examples of the present disclosure.

Referring to FIGS. 1-3 and 5, the support members 150 may be connected to the bottom end wall 110 in an offset configuration to permit the luggage case 102 to be positioned in a fully open configuration. In particular, to account for at least the size of the support members 150 (e.g., a width of the support members 150), the support members 150 may be offset laterally relative to each other along the bottom end wall 110 in a direction along a length of the split line 134 such that support members 150 extend side-by-side when the luggage case 102 is in a fully opened configuration (see FIG. 8). Without the offset nature of the present disclosure, the support members 152 of the first shell portion 130 would come into contact with the support members 154 of the second shell portion 132 and restrict the luggage case 102 from opening fully, resulting in the luggage case 102 not lying flat with the contents fully exposed. By offsetting the support members 150 along the length of the split line 134, the support member(s) 152 of the first shell portion 130 may pass the support member(s) 154 of the second shell portion 132 to facilitate the luggage case 102 to be opened fully and laid flat with its contents completely exposed for unrestricted access and packing, for instance.

For example, with reference to FIG. 5, the first support member(s) 152 of the first shell portion 130 and the second support member(s) 154 of the second shell portion 132 may be offset laterally relative to each other along the bottom end wall 110 in a direction parallel to the split line 134, which may be parallel to the hinge member 136. In other words, as best seen in FIG. 5, each of the support members 150 may be positioned discretely along a length of the split line 134 such that the support members 150 do not contact one another when the case is opened. In some embodiments, the first support members 152 on the first bottom panel portion 110A and the second support members 154 on the second bottom panel portion 110B may be positioned equidistant from the split line 134. Additionally or alternatively, the first support members 152 on the first bottom panel portion 110A may be positioned equidistant from a midline M extending substantially orthogonal to the split line 134 at a midpoint of the length of the bottom end wall 110. In such embodiments, the second support members 154 on the second bottom panel portion 110B may be positioned equidistant from the midline.

As illustrated in FIG. 5, the support members 150 may be connected to the bottom end wall 110 in a non-symmetrical manner across the split line 134. For example, the support members 150 on one of the first or second bottom panel portions 110A, 110B may be spaced further apart than the support members 150 on the other of the first or second bottom panel portions 110A, 1108. As such, the support member(s) connected to one of the shell portions 130, 132 (e.g., the first support member(s) 152 connected to the first shell portion 130) may not contact the support member(s) connected to the other shell portion (e.g., the second support member(s) 154 connected to the second shell portion 132) when the luggage case 102 is opened to permit the luggage case 102 to lay flat across a support surface. Depending on the particular configuration of the luggage case 102, in some embodiments, the first support member(s) 152 of the first shell portion 130 and the second support member(s) 154 of the second shell portion 132 may also be offset relative to each other in a direction perpendicular to the split line 134. Such a configuration may be desirable, for instance, in embodiments wherein the first and second shell portions 130, 132 are of unequal depth.

With continued reference to FIG. 5, each of the support members 150 may be positioned nearer a minor face 118 (e.g. nearer one of the left and right side walls 112, 114) than the midline M of the case defined between the left and right side walls 112, 114. Similarly, each of the support members 150 may be positioned nearer an adjacent major face 116 (e.g., nearer one of the front and rear walls 104, 106) than the split line 134 positioned between the major faces 116. In the embodiment of FIG. 5, the first support members 152 of the first shell portion 130 are positioned outboard the second support members 154 of the second shell portion 132, though the reverse may be true in some embodiments. As best seen in FIG. 5, the first support members 152 may be positioned a first distance $D_1$ away from an adjacent minor face 118. In such embodiments, the second support members 154 may be positioned a second distance $D_2$ away from the same minor face 118, the second distance $D_2$ being greater than the first distance $D_1$. In some embodiments, the second distance may be between about 1.5 times and about 3 times the first distance to allow for side-by-side nesting of the support members 150 when the luggage case 102 is in a fully open configuration. As illustrated, in some embodiments, both the first and second support members 152, 154 may be positioned outboard the hinge member 136 along the bottom end wall 110.

Referring to FIGS. 1-5, in some embodiments, each of the support members 150 may be a wheel assembly configured to rollably traverse the luggage article 100 across a support surface (e.g., across the ground). Referring to FIG. 1, each wheel assembly may preferably be a double caster wheel or similar support structure. In such embodiments, each wheel assembly includes a carriage 160 and a plurality of wheels 162 (e.g., two wheels) rotatably coupled to the carriage 160. In some embodiments, the carriage 160 may be rotatably coupled to the bottom end wall 110 such that the wheel assemblies may be considered spinner-type wheel assemblies. In such embodiments, each spinner wheel assembly includes a vertical spin axis about which the carriage 160 rotates and a horizontal axis about which the wheel(s) rotate, the wheel axis being substantially orthogonal to the vertical spin axis in some embodiments. In some embodiments, each wheel assembly may be identical or may be different based on projected loading, aesthetics, or other considerations. As shown, the luggage article 100 may include four wheel assemblies to, for example, increase the maneuverability of the luggage article 100 and/or meet consumer demands, though any combination of wheel or other support structure is contemplated.

Referring to FIG. 5, each of the first and second shell portions 130, 132 may include additional features operable to permit corresponding support members 150 to be positioned side-by-side when the luggage case 102 is opened fully. For instance, first recesses 170 may be defined in the first shell portion 130, and second recesses 172 may be defined in the second shell portion 132 (e.g., in at least the bottom end wall 110 of the luggage case 102). In such embodiments, the first support members 152 may be connected to the first shell portion 130 within the first recesses 170, and the second support members 154 may be connected to the second shell portion 132 within the second recesses 172. As described below, each of the support members 150 may be positioned at least partially within a corresponding recess 170 or 172 formed in an opposing shell portion 130 or 132 to facilitate opening the luggage case 102 to the fully open configuration. Each of the recesses 170, 172 may include a length dimension, a width dimension, and a depth dimension, the length dimension extending substantially along the same direction as the length of the bottom end wall 110. In some embodiments, the length dimension of each of the recesses 170, 172 may be greater than a largest lateral dimension of the support members 150 received therein. The largest lateral dimension may be the diameter of the wheels 162, may be twice the diameter of the wheels 162, or any other dimension configured to receive corresponding support members 150 in a side-by-side orientation.

To account for side-by-side positioning of the first and second support members 152, 154 when the luggage case 102 is fully opened, each of the first and second recesses 170, 172 may be elongated along the length of the bottom end wall 110. For example without limitation, each of the first and second recesses 170, 172 may be elongated in a direction parallel to the split line 134 and sufficient to receive at least a portion of the first and second support members 152, 154 therein when the luggage case 102 is opened. In such embodiments, each of the first and second recesses 170, 172 may include a length substantially equal to or greater than a combined width of the first and second support members 152, 154. In such embodiments, each of the support members 150 is positioned at least partially along the length of the recess 170 or 172 in which an opposing one of the support members 150 is positioned when the luggage case 102 is opened to lay flat. In some embodiments, the elongated length of the each recess may be sufficient to receive the first and second support members 152, 154 therein regardless of the rotational position of the first and second support members 152, 154 relative each other.

In one embodiment, each of the recesses 170, 172 may include a depth sufficient to allow the luggage case 102 to lay flat when fully opened to account for relatively large diameter wheels 162 of the support members 150. For example, the depth dimension of the recesses 170, 172 may be sized to receive at least a portion of a height dimension of an opposing support member 150 when the luggage case 102 is in the fully open orientation. For example, the recesses 170, 172 may be sized to receive at least a portion of the wheels 162 of the support members 150, including less than ½ the diameter of the wheels 162, up to ½ the diameter of the wheels 162, or more than ½ the diameter of the wheels 162 up to at least the full diameter of the wheels 162. In such embodiments, the size of each of the wheels 162 affects how much of the wheels 162 is received within the recesses 170, 172. The greater amount received within the recesses 170, 172, the less space between the first and second shell portions 130, 132 when the luggage case 102 is opened to lay flat. In some embodiments, each of the recesses 170, 172 may be sized and shaped to permit rotational movement of the wheel assemblies therein. For example, the edges defined by the intersection of the recesses 170, 172 and the shell portions 130, 132 may be shaped to allow unrestricted movement of the wheel assembly(ies) positioned therein, regardless of whether the luggage case 102 is in an open or closed configuration. Though the recesses 170, 172 may aid in fully opening the luggage case 102, in some embodiments, no portion of the support members 150 may be received within the recesses 170, 172 when the luggage case 102 is opened to lay flat. For example, with reference to FIG. 8, the offset nature of the support members 150 may permit the support members 150 to pass by each other to allow 180 degree opening of the luggage case 102 without the recesses 170, 172.

Figure 3:
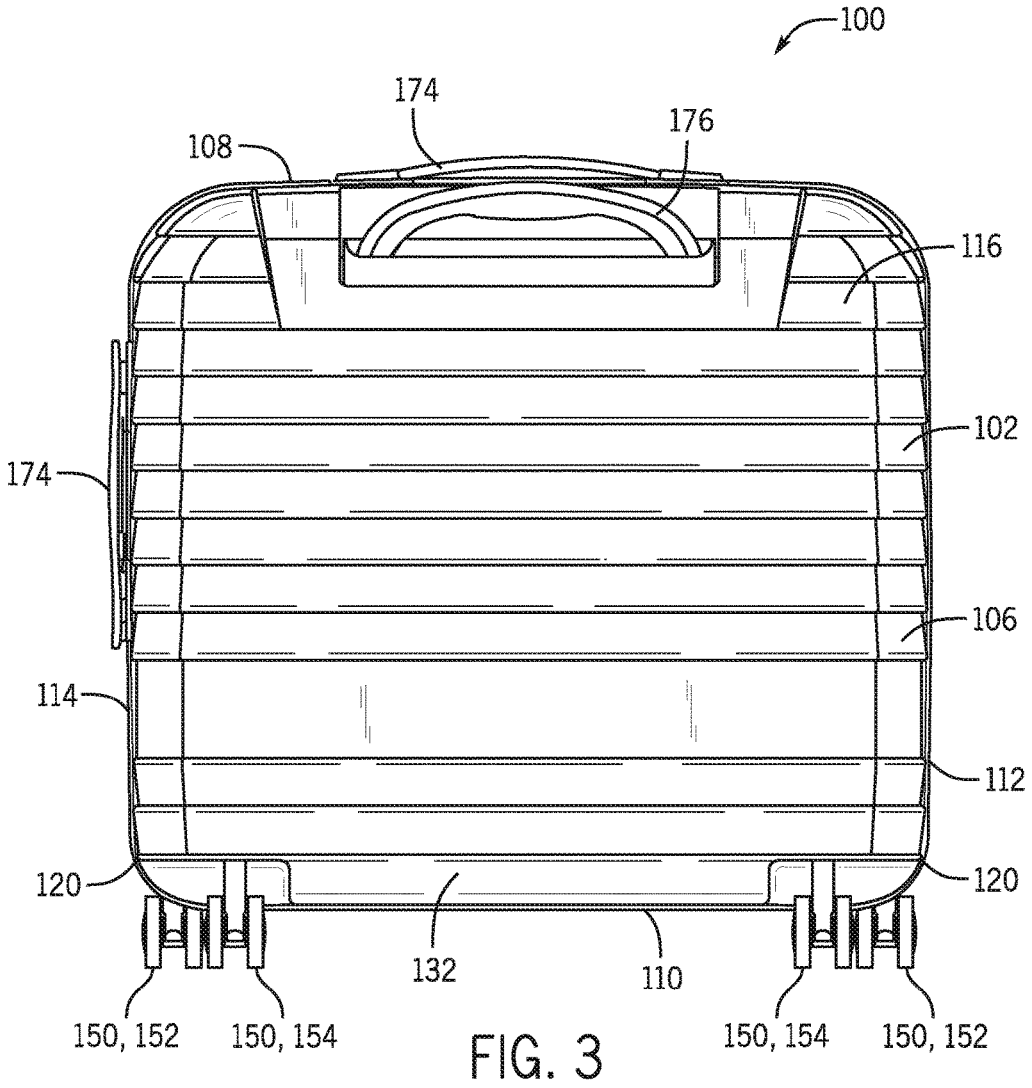
FIG. 3 is a rear elevation view of the luggage article of FIG. 1 in accordance with some examples of the present disclosure.
Figure 4:
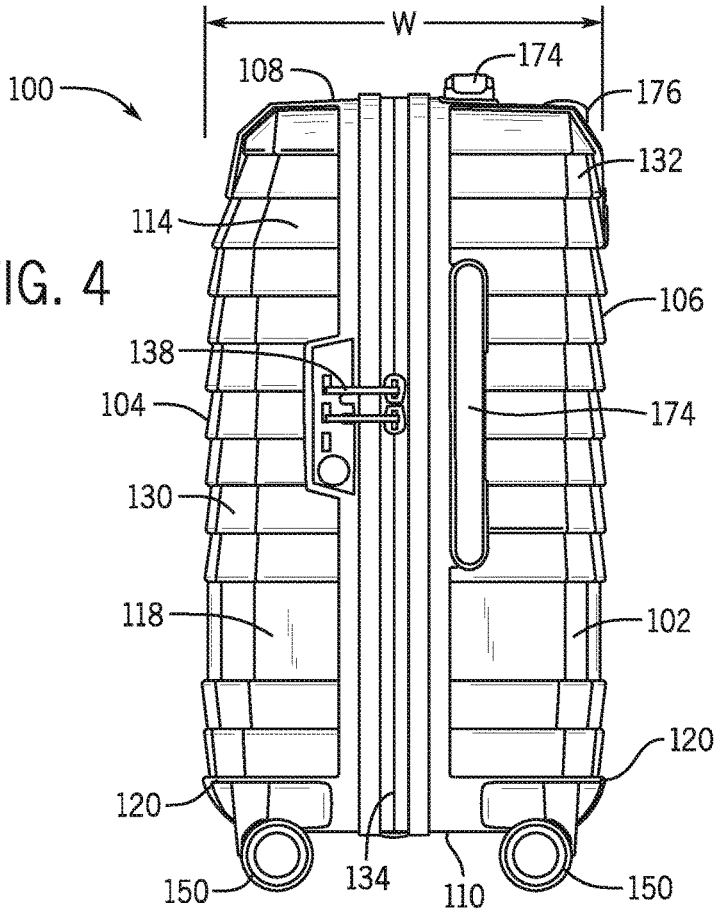
FIG. 4 is a side elevation view of the luggage article of FIG. 1 in accordance with some examples of the present disclosure.
Figure 5:
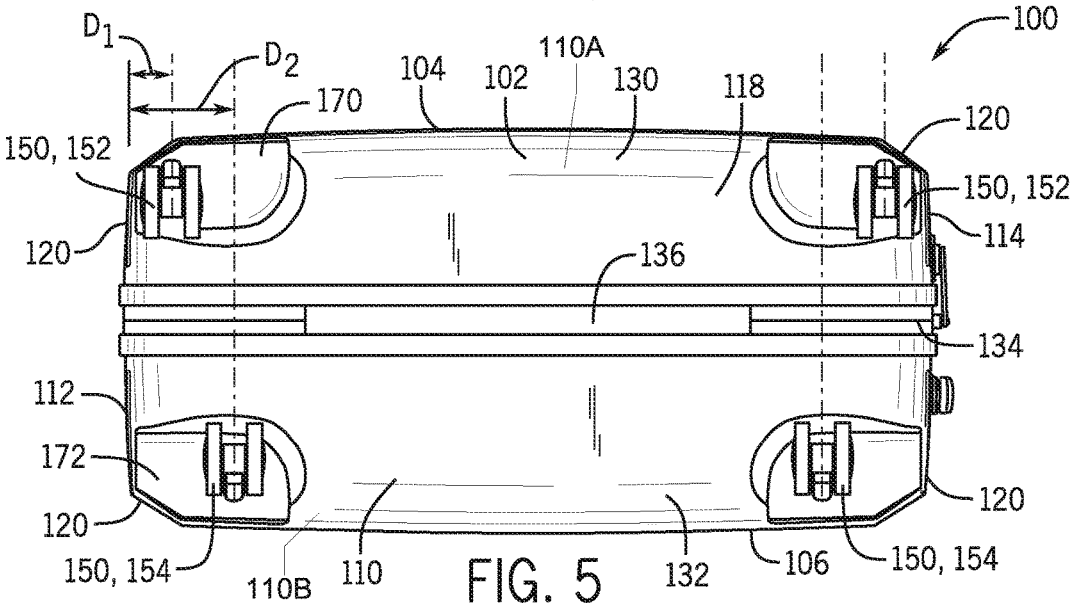
FIG. 5 is a bottom plan view of the luggage article of FIG. 1 in accordance with some examples of the present disclosure.
Figure 6:
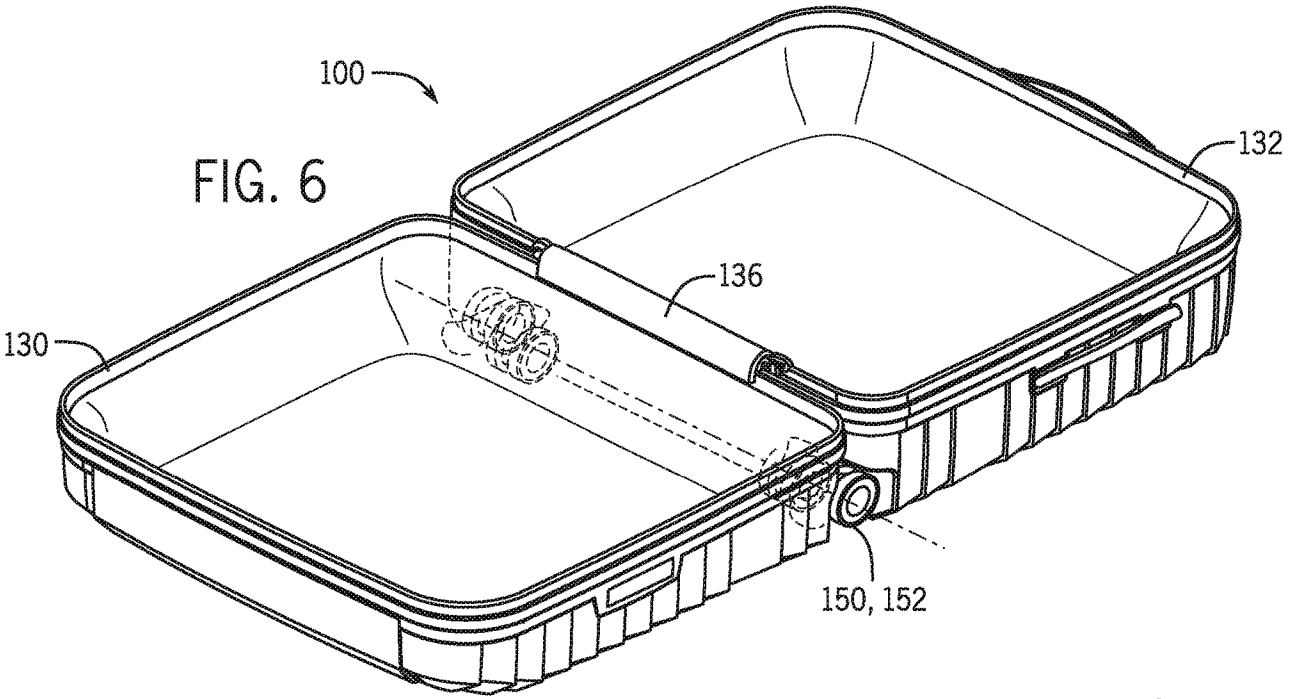
FIG. 6 is a top isometric view of the luggage article of FIG. 1 in an open configuration in accordance with some examples of the present disclosure.
Figure 7:
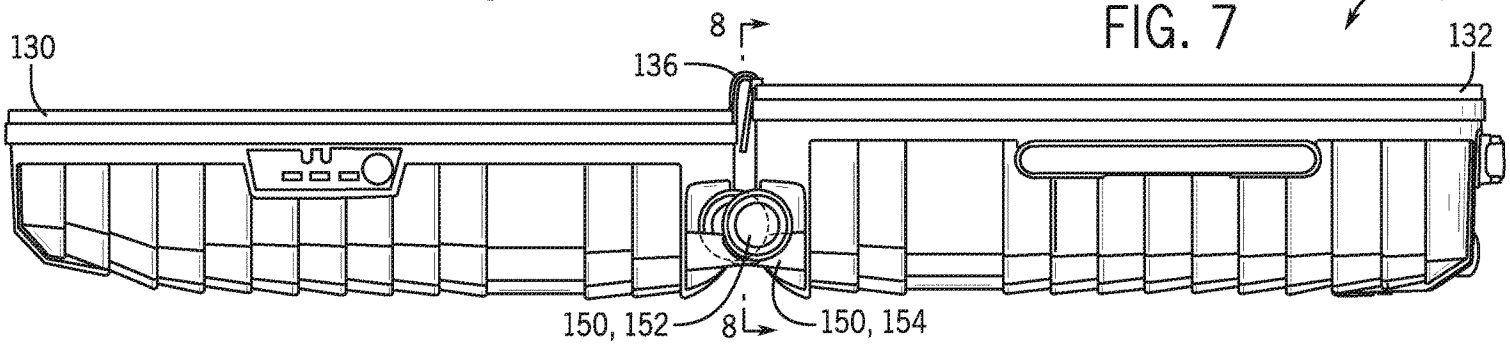
FIG. 7 is a side elevation view of the luggage article of FIG. 6 in accordance with some examples of the present disclosure.

With reference to FIGS. 1, 3, and 4, for instance, the luggage article 100 may include other features for convenience. For example, the luggage article 100 may include at least one carry handle 174 attached to at least one of the minor faces 118 of the luggage article 100 (e.g., to the top end wall 108 and to the right side wall 114). In some embodiments, the luggage article 100 may include an extendable handle 176, which may be aligned along the outside of the second shell portion 132 (e.g., along the rear wall 106) of the luggage article 100. The extendable handle 176 may be aligned along the second shell portion 132 but positioned inside the luggage article 100 and extending through one of the minor faces 118 of the luggage article 100 (e.g., through the top end wall 108). Although described in association with the second shell portion 132 and/or the minor faces 118, respectively, the extendable handle 176 and the carry handle(s) 174 may be associated with any face, wall, or side of the luggage article 100.

The luggage article 100 may be a bag, a case, a backpack, or any other suitable luggage article 100, and the luggage article 100 may be soft sided, hard sided, or a hybrid combination of hard and soft sides. For example, the luggage article 100 may be moldable hard side material, soft side material, or a combination of hard side material and soft side material. The soft side material may be nylon, canvas, polyester, leather, PVC, polypropylene, polyethylene, and/or PTFE, among others. The hard side material may be a thermoplastic material (self-reinforced or fiber reinforced), ABS, polycarbonate, polypropylene, polystyrene, PVC, polyamide, and/or PTFE, among others. The luggage article 100 may be formed or molded in any suitable manner, such as by plug molding, blow molding, injection molding, or the like. Additionally, the thickness of the luggage article 100 may be consistent, or may vary across the luggage article 100 depending on the desired rigidity, strength, and/or weight of the luggage article 100. For instance, the thickness of the luggage article 100 may be greater near the wheel assemblies, the edges, and/or the split line 134. Each of the walls may be referred to as a panel, a face, or a side.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A luggage case comprising:

a housing including a bottom panel and including first and second shell portions movable relative to each other between a closed positon and an open position about a split line extending along a length of the bottom panel to define a first bottom panel portion and a second bottom panel portion;

the bottom panel including at least four support members, with at least two support members on each of the first and second bottom panel portions;

wherein the at least two support members on the first bottom panel portion are offset from the at least two support members on the second bottom panel portion in a direction extending at least partially along the split line;

wherein each of the at least two support members on the first bottom panel portion are received in a corresponding recess formed at least partially in the second bottom panel portion when the housing is in the open position;

wherein each of the at least two support members on the second bottom panel portion are received in a corresponding recess formed at least partially in the first bottom panel portion when the housing is in the open position;

wherein each recess has a length dimension; and wherein when in the open position, at least one support member is positioned at least partially along the length dimension of the recess in which an opposing support member is positioned.

2. The luggage case of claim 1, wherein the direction extends parallel to the split line.

3. The luggage case of claim 1, wherein the at least two support members on the first bottom panel portion and the at least two support members on the second bottom panel portion are positioned equidistant from the split line.

4. The luggage case of claim 1, wherein at least a portion of the split line extending along the bottom panel is a hinge.

5. The luggage case of claim 1, wherein the at least two support members on one of the first or second bottom panel portions are spaced further apart than the at least two support members on the other of the first or second bottom panel portions.

6. The luggage case of claim 1, wherein:

a midline extends orthogonally to the split line at a midpoint of the length of the bottom panel; and the at least two support members on the first bottom panel portion are positioned equidistant from the midline; and the at least two support members on the second bottom panel portion are positioned equidistant from the midline.

7. The luggage case of claim 1, wherein the support members are wheels.

8. The luggage case of claim 1, wherein:

the open position includes a fully open orientation wherein the two shells extend in generally opposing directions from the split line; and in the fully open orientation each of the at least two support members on the first bottom panel portion are positioned adjacent to an opposing one of the at least two support members on the second bottom panel portion.

9. The luggage case of claim 1, wherein:

each of the at least two support members on the first bottom panel portion and the at least two support members on the second bottom panel portion have a height dimension; and each of the corresponding recesses have a width dimension, and a depth dimension.

10. The luggage case of claim 9, wherein the length dimension of each of the corresponding recesses is greater than a largest lateral dimension of the corresponding support member.

11. The luggage case of claim 9, wherein the depth dimension of each of the corresponding recesses is at least sufficient to receive at least a portion of the height dimension of an opposing support member when in the fully open orientation.

12. The luggage case of claim 11, wherein:

each of the support members includes a wheel; and the depth dimension of each of the corresponding recesses is sufficient to receive at least a portion of the wheel.

13. A luggage article comprising:

a luggage case including first and second shell portions pivotably connected together at a split line;

a first recess defined in the first shell portion;

a second recess defined in the second shell portion;

a first support member connected to the first shell portion within the first recess;

a second support member connected to the second shell portion within the second recess and generally opposite the first support member across the split line;

wherein the first and second support members are offset laterally relative to each other in a direction at least partially along a length of the split line;

wherein each of the first and second recesses are elongated along a direction parallel to the split line sufficient to receive at least a portion of the first and second support members therein when the case is opened fully; and wherein at least a portion of the first and second support members are received within the second and first recesses, respectively, when the luggage case is moved to an open position.

14. The luggage article of claim 13, wherein the first and second support members are offset relative to each other in a direction parallel to the split line.

15. The luggage article of claim 13, wherein the first and second support members are offset relative to each other in a direction perpendicular to the split line.

16. The luggage article of claim 13, wherein the offset nature of the first and second support members allows the luggage case to be opened at least 180 degrees.

17. The luggage article of claim 13, wherein the first and second shell portions are of equal depth.

18. The luggage article of claim 13, wherein each of the first and second support members is a dual caster wheel assembly.

19. The luggage article of claim 13, further comprising a hinge member connecting the first and second shell portions together to form the pivotable connection.

20. The luggage article of claim 13, wherein each of the first and second recesses includes a length substantially equal to or greater than a combined width of the first and second support members.

21. A luggage article comprising:

a luggage case including first and second shell portions pivotably connected together at a split line along a bottom end wall of the luggage case, each of the first and second shell portions including at least one recess defined on the bottom end wall;

a plurality of support members connected to the bottom end wall, each of the first and second shell portions including at least one of the plurality of support members;

wherein the at least one support member connected to one of the first and second shell portions is offset in a lateral direction along the bottom end wall and parallel to the split line;

wherein the at least one support member is connected to the first shell portion within the at least one recess defined in the first shell portion and further is received within the at least one recess defined on the bottom wall of the second shell portion when the luggage case is in an open position; and wherein the at least one support member is connected to the second shell portion within the at least one recess defined in the second shell portion and further is received within the at least one recess defined on the bottom wall of the first shell portion when the luggage case is in the open position.

22. A luggage article comprising:

a luggage case including first and second shell portions connected together along a bottom end wall by a hinge member;

a plurality of first recesses defined in the first shell portion;

a plurality of second recesses defined in the second shell portion;

a plurality of first support members connected to the first shell portion;

a plurality of second support members connected to the second shell portion;

wherein each of the first support members is offset laterally relative to a corresponding second support member along the bottom end wall in a direction parallel to the hinge member;

wherein the first support members are connected to the first shell portion within the first recesses and are received within the second recesses of the second shell portion when the luggage case is moved to an open position; and wherein the second support members are connected to the second shell portion within the second recesses and are received within the first recesses of the first shell portion when the luggage case is moved to the open position.

23. The luggage article of claim 22, wherein the plurality of first support members are positioned outboard of the plurality of second support members.

24. The luggage article of claim 22, wherein the plurality of second support members are positioned outboard of the plurality of first support members.

* * * * *